US006043787A

United States Patent [19]

Sanford et al.

[11] Patent Number: 6,043,787

[45] Date of Patent: Mar. 28, 2000

[54] BEAM MODIFYING TROUGH WAVEGUIDE ANTENNA

[75] Inventors: John R. Sanford, Palo Alto; James A. Wilfong, San Carlos, both of Calif.

[73] Assignee: Endgate Corporation, Sunnyvale, Calif.

[21] Appl. No.: 08/934,251

[22] Filed: Sep. 19, 1997

[51] Int. Cl.[7] ..... H01Q 13/02

[52] U.S. Cl. ..... 343/772; 343/786

[58] Field of Search ..... 343/772, 786; H01Q 13/02, 13/06

[56] References Cited

U.S. PATENT DOCUMENTS

| | | | |
|---|---|---|---|
| 2,943,325 | 6/1960 | Rotman | 343/772 |
| 2,957,173 | 10/1960 | Rotman | 343/772 |
| 3,013,267 | 12/1961 | Rotman | 343/772 |
| 3,015,100 | 12/1961 | Rotman | 343/772 |
| 3,653,054 | 3/1972 | Wen | 343/772 |
| 4,788,554 | 11/1988 | Smith | 343/786 |

*Primary Examiner*—Michael C. Wimer
*Attorney, Agent, or Firm*—Steven J. Adamson; Edward B. Anderson

[57] ABSTRACT

A trough waveguide antenna that has a septum and opposing bases and side walls. In one embodiment, the bases are undulated and asymmetrically disposed about the septum. The magnitude, periodicity and length, etc., of the undulations may be varied for performance. The configuration of the septum may be similarly varied. Other mechanisms for achieving energy radiation are also disclosed as are cost effective fabrication techniques.

22 Claims, 3 Drawing Sheets

Fig. 1
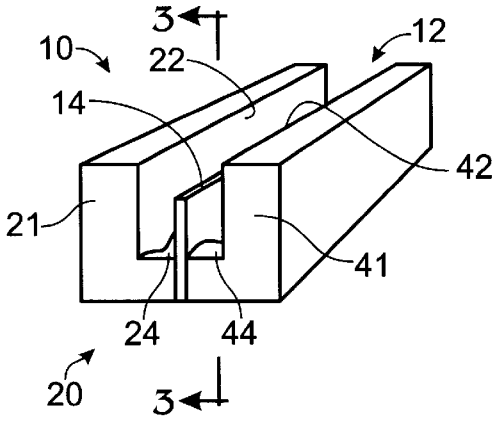
Fig. 2
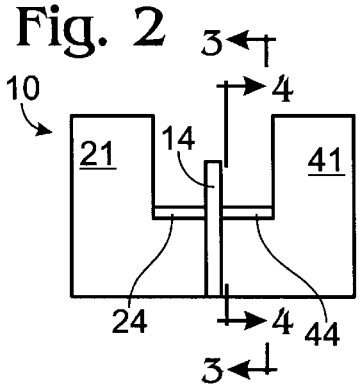
Fig. 3
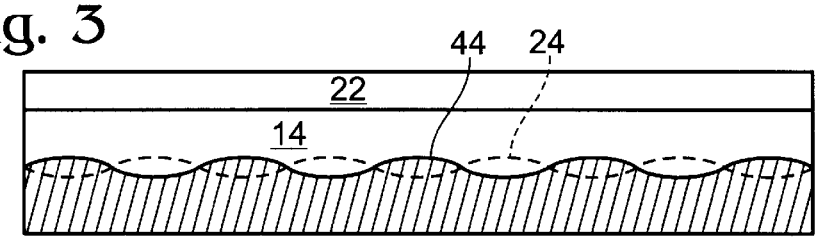
Fig. 4
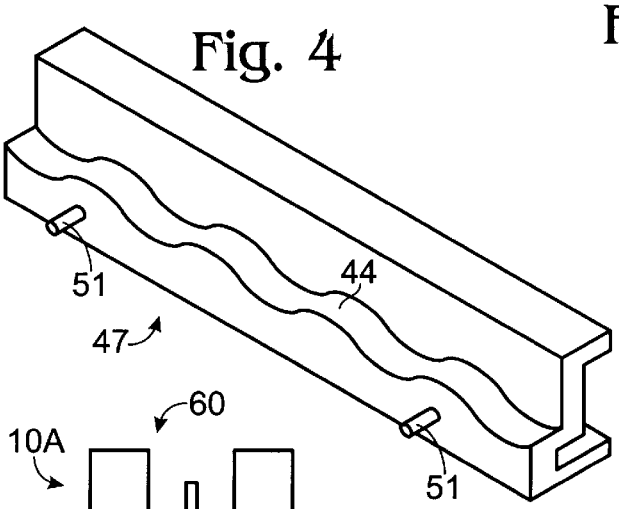
Fig. 5B
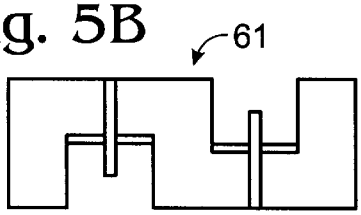
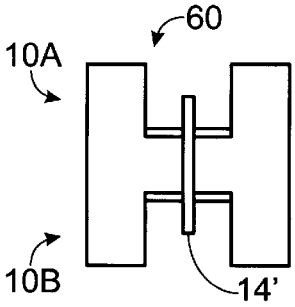
Fig. 5A
Fig. 5C
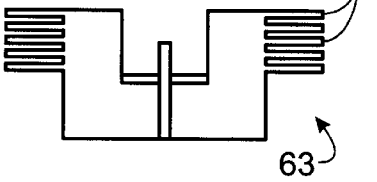

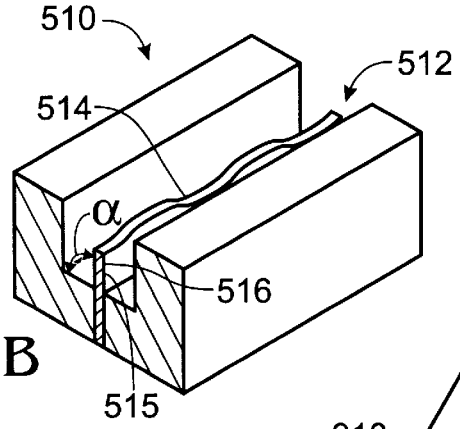
Fig. 10B
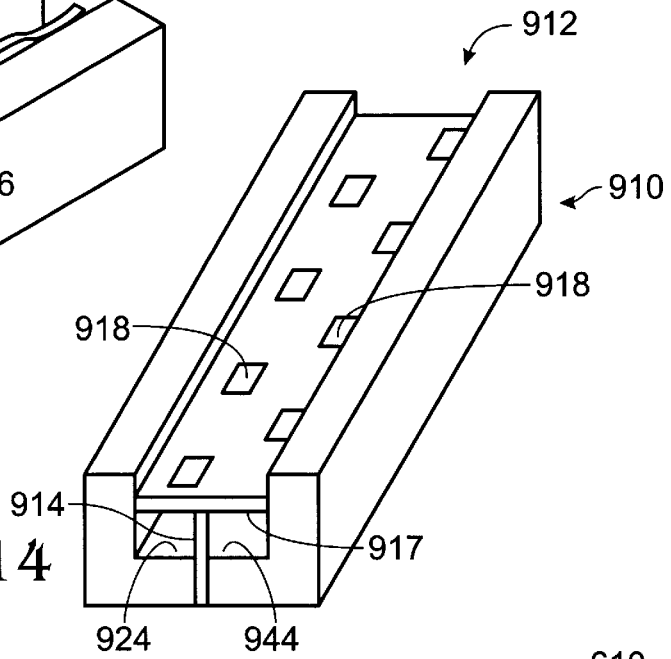
Fig. 14
Fig. 11
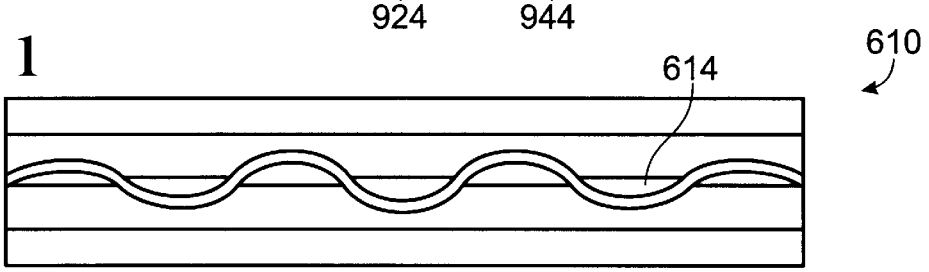
Fig. 12
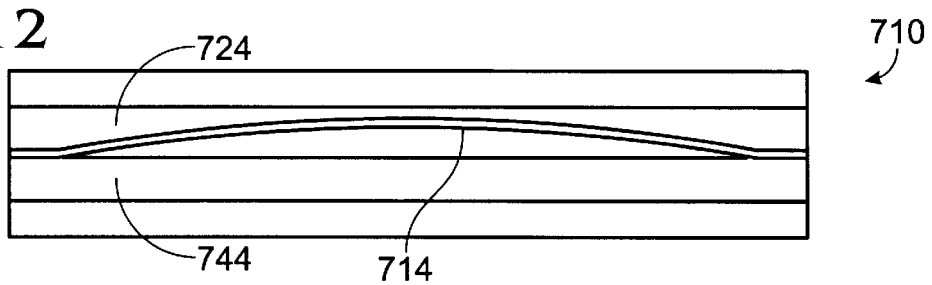
Fig. 13
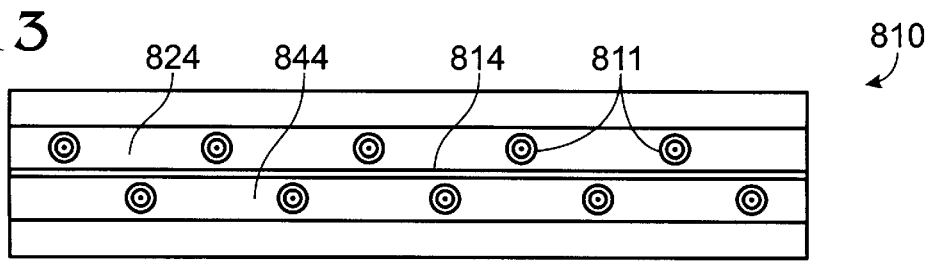

BEAM MODIFYING TROUGH WAVEGUIDE ANTENNA

FIELD OF THE INVENTION

The present invention relates to waveguide antennas and, more specifically, to trough waveguide antennas.

BACKGROUND OF THE INVENTION

Amongst other reasons, the FCC's proposed redistribution of the 27.5 to 29.5 GHz frequency band for Local Multipoint Distribution Services (LMDS) has generated a need for improved antennas. Desired improvements include the ability to more accurately control the pattern of an emitted beam and to facilitate highly power efficient transmission. With respect to LMDS systems, desired improvements also include those which enhance support of broadband two way video communication in a cell-based system.

Prior art attempts, including slotted waveguide antennas, have heretofore been unable to or have had difficulty in developing a millimeter waveguide antenna that is capable of achieving the above objectives in a manner which is both economical and energy efficient. Although relatively efficient millimeter wave antenna architectures have been described, the complexity of many such architectures has resulted in comparatively high production and development costs. For example, the slots of slotted waveguide antennas must be machined to very precise tolerances, thus requiring expensive precision machining and being subject to an undesirably high rejection rate.

With respect to less expensive antennas such as inexpensive planar array antennas and the like (e.g., microstrip printed patch arrays), these devices may provide the requisite directivity, but are typically inefficient due to the utilization of lossy feed networks in the distribution of power to the array radiators.

SUMMARY OF THE INVENTION

Accordingly, it is an object of the present invention to provide an antenna that efficiently and controllably emits a desired radiation pattern.

It is another object of the present invention to provide an antenna that affords a designer with several degrees of freedom in designing the antenna to produce a desired radiation pattern.

It is another object of the present invention to provide an antenna with high tolerance insensitivity.

It is also an object of the present invention to provide such an antenna that can be economically produced.

These and related objects of the present invention are achieved by use of a beam modifying trough waveguide antenna as described herein.

In one embodiment, the invention includes a first conductive trough having first and second opposing side walls and first and second bases, said first base connected to said first side wall and disposed toward said second base and said second base connected to said second side wall and disposed towards said first base; and a septum provided between and extending above said first and second bases; wherein at least one of said first and second bases has undulations that are asymmetric about said septum from the other of said first and second bases. The asymmetry may be periodic or aperiodic. The undulations may be sinusoidal and their amplitude and frequency may vary depending on desired emission/reception characteristics. The height of the septum may vary along the length of the antenna and the shape of the septum may be modified to provide filtering and/or beam shape modification. The invention also includes omnidirectional or multi-directional embodiments, as well as absorber arrangements for use with the trough waveguide antenna.

In another embodiment, the invention includes a conductive trough having first and second opposing side walls and first and second bases, said first base connected to said first side wall and disposed toward said second base and said second base connected to said second side wall and disposed towards said first base; and a septum provided between and extending above said first and second bases; wherein at least a portion of said septum is undulated. The septum undulations and the height of the septum relative to one or more bases may vary along the length of the septum.

In another embodiment, the present invention includes a conductive trough having first and second opposing side walls and first and second bases, said first base connected to said first side wall and disposed toward said second base and said second base connected to said second side wall and disposed towards said first base; a septum provided between and extending above said first and second bases; and an energy radiating member provided above and spaced from said bases, said member having conductive regions arranged asymmetrically about said septum.

In yet another embodiment, the invention includes a first conductive subsection including a first base integrally formed with a first side wall; a second conductive subsection including a second base integrally formed with a second side wall; and a septum mounted between said first and second subsections, said first and second subsections being disposed such that the first and second bases are adjacent said septum. The first and second bases are preferably asymmetric about the septum and may contain undulations. The septum may vary in height relative to the bases and may contain undulations. An energy radiating member may provided above and spaced from said bases, said member having conductive regions arranged asymmetrically about said septum. A contour of the subsections is preferably formed by extrusion.

The attainment of the foregoing and related advantages and features of the invention should be more readily apparent to those skilled in the art, after review of the following more detailed description of the invention taken together with the drawings.

BRIEF DESCRIPTION OF THE DRAWINGS

FIG. 1 is a perspective view of a trough waveguide antenna in accordance with the present invention.

FIG. 2 is a longitudinal side view (end view) of the antenna of FIG. 1 in accordance with the present invention.

FIG. 3 is a cross-sectional latitudinal side view of the antenna of FIG. 1 in accordance with the present invention.

FIG. 4 is a perspective view of a subsection of the antenna of FIG. 1 in accordance with the present invention.

FIGS. 5A–5C are longitudinal side views (end views) of omnidirectional antenna arrangements in accordance with the present invention.

FIGS. 10A–10B are a top view and a perspective cross-sectional longitudinal side view, respectively, of another alternative embodiment of an antenna in accordance with the present invention.

FIG. 11 is a top view of another alternative antenna embodiment in accordance with the present invention.

FIG. 12 is a top view of another alternative antenna embodiment in accordance with the present invention.

FIG. 13 is a top view of another alternative antenna embodiment in accordance with the present invention.

FIG. 14 is a perspective end view of an alternative antenna embodiment in accordance with the present invention.

DETAILED DESCRIPTION

Figure 6:
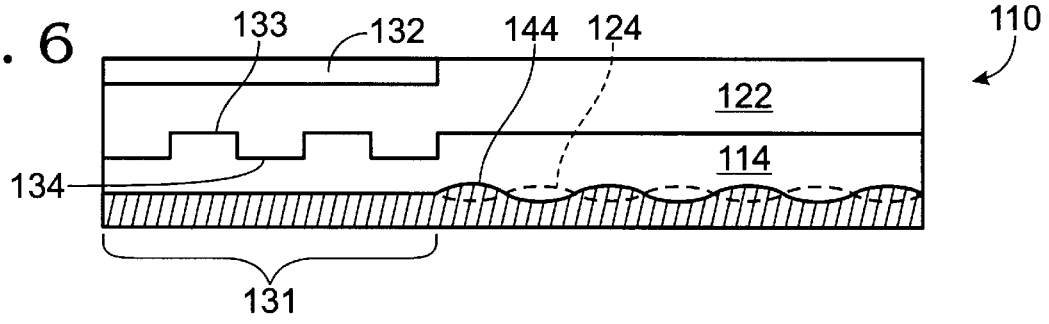
FIG. 6 is a cross-sectional latitudinal side view of an alternative antenna embodiment in accordance with the present invention

While the antennas and antenna arrangements discussed herein are well suited for millimeter wave operation, it should be recognized that the teachings herein are applicable to operation at any frequency.

Referring to FIG. 1, a perspective view of a trough waveguide antenna 10 in accordance with the present invention is shown. Antenna 10 includes a trough or main channel 12 which is separated by a septum 14 into first and second halves 20 and 40. First and second radiation guide members 21,41 (referred to as subsections elsewhere herein) define opposing channel wall surfaces 22,42 and first and second bases 24,44 define the bottom of channel 12. Energy is preferably coupled into the antenna with a waveguide launch (not shown) having a septum that gradually increases in height from zero to that of septum 14 to minimize reflection. Launches of this or other types may be provided on one or both ends of the antenna. The provision of launches on both ends permits two frequencies to be emitted (or received) from the same antenna or for an antenna to be used for both transmit and receive.

Bases 24,44 are preferably sinusoidally shaped and are periodically offset by 180 degrees (though the undulations may be aperiodic). The asymmetry of bases 24,44 causes energy to be expelled from the main channel or trough. The sinusoidal configuration shown in FIGS. 1–4, amongst others, provides energy efficient beam shaping and permits broadside emission of signals from antenna 10. Energy efficient radiation is achieved by the smoothly undulated surfaces of bases 24,44. Formation of the sinusoidally varying surfaces and the other methods of achieving asymmetry discussed herein provide relatively low cost methods of achieving a desired asymmetry. More gently sloping undulations reduce signal reflection.

Referring to FIGS. 2–3, a longitudinal side view (an end view) and a cross-sectional latitudinal side view of the antenna of FIG. 1 in accordance with the present invention are respectively shown. In FIG. 3, base 44 is illustrated with a solid line while base 24 is illustrated with a dashed line. FIGS. 2–3 illustrate that bases 24,44 preferably begin at the same level with base 24 descending from the left hand side and base 44 ascending from the left hand side. The other end of the antenna may include another launch, an absorber (of material discussed below), or a connector coupled to an alarm that indicates when signal is not being propagated into the antenna, amongst other devices or configurations.

Referring to FIG. 4, a perspective view of a subsection 47 of an antenna 10 in accordance with the present invention is shown. This subsection includes base 44, radiation guide member 41 and alignment pins 51. The alignment pins are positioned in holes (obscured by the pins) bored in subsection 47 and are utilized in mounting the septum and the complementary subsection that includes base 24 and guide member 21. Holes are drilled in the septum that align with pins 51. The septum is then slid over the pins and the complementary subsection is mounted flush against the septum (pins 51 fitting into corresponding bore holes) to form a completed antenna.

The embodiment of FIG. 4 is preferably formed by extrusion of aluminum or other suitable material through a mold having a cross-section generally as shown in FIG. 4. The pattern of sinusoidally varying base 44 is milled from the extrusion product. Extrusion permits the formation of a structure in which minimalistic amount of aluminum or other starting material is used, thus realizing a considerable savings in the cost of raw material (note the shape of subsection 47). Machining of the undulations (or counter bores or the like discussed below) is a relatively straight forward process, thereby facilitating low cost antenna manufacture. Other forms of manufacture include die casting metal and mold forming plastic followed by formation of a conductive plating thereon.

Referring to FIG. 5A, a longitudinal side view of a substantially omnidirectional antenna arrangement 60 in accordance with the present invention is shown. The arrangement 60 is essentially comprised of two antennas 10A,10B that are arranged back-to-back. The main channels of antennas 10A,10B may be configured to form a beam having a sector (in azimuth) approaching 180 degrees. Accordingly, placement of two antennas back-to-back achieves a radiation pattern of approximately 360 degrees in azimuth. If the antennas of arrangement 60 produce broadside emissions, then the resultant radiation pattern of arrangement 60 is omnidirectional, plane polarized. In a preferred application for transmission of signals from one cell to another, antenna arrangement 60 is positioned vertically such that signals propagate in a plane generally parallel with earth's surface, i.e., the antenna emission are horizontally polarized. Antenna arrangement 60 can be made with the three part approach described with reference to FIG. 4. The septum plate 14' is provided between two complementary subsections (left side, right side) that have appropriately manufactured base surfaces.

Referring to FIG. 5B, another omnidirectional, plane polarized antenna arrangement 61 in accordance with the preset invention is shown. Arrangement 61 provides two antennas that are positioned side-by-side and oppositely facing. The approximately 180 degrees azimuth sectors of each antenna (when positioned vertically) combine to form an approximately 360 degree radiation pattern. Broadside emission achieves horizontal plane polarization.

Referring to FIG. 5C, a longitudinal side view of an antenna 63 having side flares 64 in accordance with the present invention is shown. Side flares 64 cause radiation emitted from the main channel to move outwardly in a direction perpendicular to the plane of the septum, thereby providing a more evenly distributed emission pattern. The provision, for example, of two antennas 63 in a back-to-back arrangement would produce a more evenly distributed omnidirectional emission pattern than arrangement 60 of FIG. 5A.

Referring to FIG. 6, a cross-sectional latitudinal side view of an antenna 110 in accordance with the present invention is shown. The septum 114, interior wall 122 and first and second bases 124,144 are shown in this view, as are a filter 131 and an absorber 132. The filter 131 has peaks 133 and valleys 134 that are arranged to provide a desired amount of filtering. The filter is preferably formed as a plurality of square or rectangular wave structures and a preferred length of each wave is a wavelength of the frequency to be radiated from antenna 110. A length of a peak 133 may thus be an appreciable fraction of that wavelength. A design criteria for configuring filter 131 is to achieve the reflection of unwanted frequencies. It should be noted that the top of the square waves may extend above the height of the septum and the corners of the peaks may be softened to reduce reflection. In general, the height and width of the peaks (and corresponding valleys) may be modified to give a desired performance.

Antenna 110 also includes an absorber 132. Absorber 132 is preferably provided on both interior walls adjacent and/or above the filter. The absorber is formed of a material that absorbs some frequencies above and/or below the desired transmission frequency. In a preferred embodiment, higher frequencies are absorbed while lower frequencies are cut off by filter 131. A suitable absorber material, for example, is "Echo-sorb" which is available commercially. This material may also be used at the far end of the antenna. The filter and absorber function in both transmission and receipt.

Figure 7:
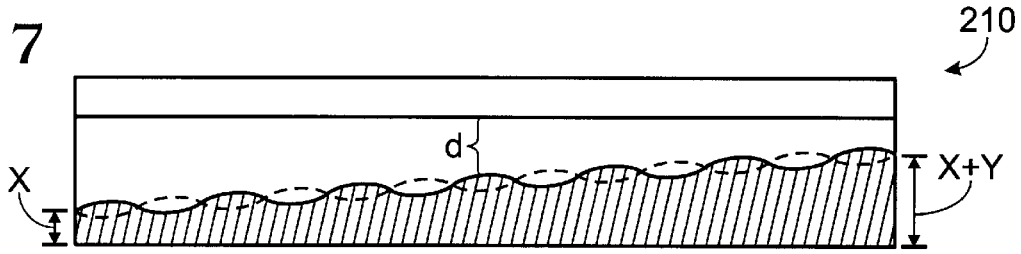
FIG. 7 is a cross-sectional latitudinal side view of another alternative antenna embodiment in accordance with the present invention.

Referring to FIG. 7, a cross-sectional latitudinal side view of an antenna 210 in accordance with the present invention is shown. Antenna 210 preferably contains the periodically asymmetric bases of FIG. 1 (either sinusoidal or an equivalent thereof). Antenna 210 can be distinguished from antenna 10 in that the depth of the bases relative to the septum varies along the length of the septum.

In the embodiment of FIG. 7, the depth of bases 224,244 decreases from the input (left hand side) . The distance, d, between the top of the septum and the bases controls phase velocity of an emitted signal. The ability to vary phase velocity permits generation of non-uniform phase tapers and thus provides a designer with another degree of freedom in shaping a beam.

Figure 8:
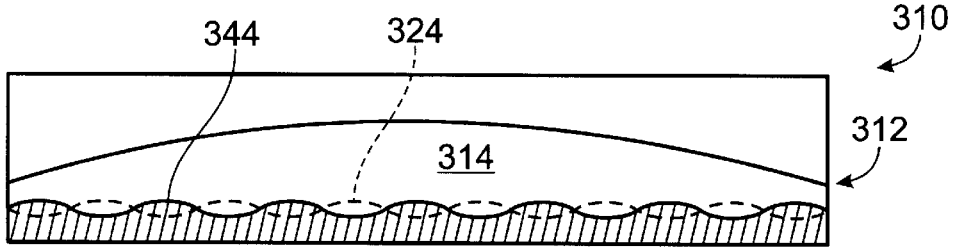
FIG. 8 is a cross-sectional latitudinal side view of another alternative antenna embodiment in accordance with the present invention.

Referring to FIG. 8, a cross-sectional latitudinal side view of an antenna 310 in accordance with the present invention is shown. Antenna 310 in analogous to antennas 10 and 210 and includes a septum 314, bases 324,344 and a main channel 312, amongst other features. In the embodiment illustrated in FIG. 8, the height of bases 324,344 remains constant, while the height of the septum varies relative to the height of the bases. As discussed with reference to FIG. 7, the distance between the surface of the bases and the top of the septum controls the phase velocity of emitted signals. Hence, the embodiment of FIG. 8 illustrates an alternative embodiment for controlling phase velocity.

Figure 9:
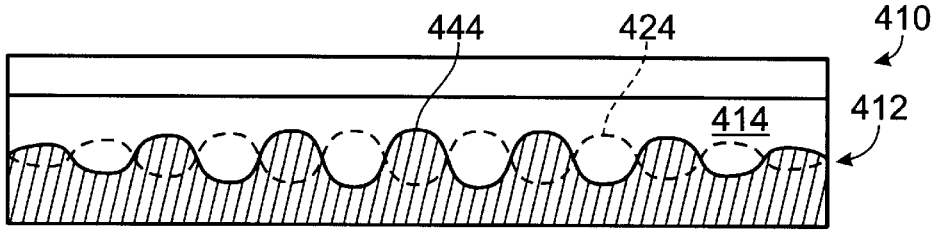
FIG. 9 is a cross-sectional latitudinal side view of another alternative antenna embodiment in accordance with the present invention.

Referring to FIG. 9, a cross-sectional latitudinal side view of an antenna 410 in accordance with the present invention is shown. Antenna 410 is analogous to antenna 10, for example, in that antenna 410 includes bases 424,444 that are separated by a septum 414 and provided in a main channel 412. In addition, the embodiment of FIG. 9 illustrates that the amplitude of the sinusoidal bases 424,444 varies with length. The amplitude of the sinusoidal waves which define the surfaces of bases 424,444 is increased in magnitude towards the center of the antenna, relative to the amplitude at the ends of the antenna. The increased amplitude serves to expel an increased amount of energy (radiated signal) from the center region of the antenna.

Figure 10A:
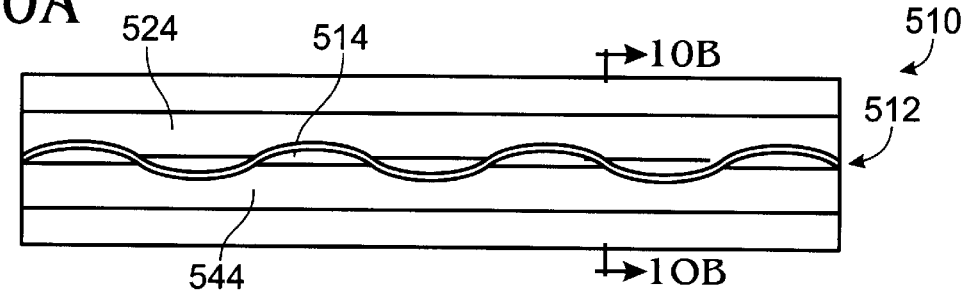

Referring to FIGS. 10A–10B, a top view and a perspective cross-sectional longitudinal side view, respectively, in accordance with the present invention are shown. Antenna 510 is analogous to antenna 10 and includes a main channel 512, a septum 514 and bases 524,544. In contrast to the substantially straight septum and undulated bases of antenna 10, septum 514 is undulated and bases 524,544 may be straight. In a preferred embodiment, the bottom 515 of septum 514 (at bases 524,544) is straight while the undulations increase in amplitude towards the top 516 of the septum. This configuration causes energy to be expelled from the trough.

Since the septum configuration of antenna 510 causes energy to be expelled, it is not necessary that bases 524,544 have asymmetric height variations. The provision, however, of such variations as disclosed in antenna 10 and the like (antenna 410 discloses varying sinusoidal amplitude, antenna 810 discloses coined base asymmetry and antenna 910 discloses a base asymmetry equivalent) may afford additional beam shaping and energy expulsion capabilities.

Referring to FIG. 11, a latitudinal top view of an antenna 610 in accordance with the present invention is shown. Antenna 610 is analogous to antenna 510 and provides, amongst other features, a sinusoidally undulated septum. Antenna 610, however, further provides a septum 614 wherein the amplitude of the undulations vary along the length thereof. In a preferred embodiment, the amplitude of the undulations increase towards the center of the antenna. The increased amplitude serves to expel more energy as discussed above with respect to the increased amplitude undulations of bases 424,444. In addition, the configuration of antenna 610 produces a beam with significantly reduced sidelobes.

Referring to FIG. 12, a latitudinal top view of an antenna 710 in accordance with the present invention is shown. Antenna 710 is analogous to antenna 510, amongst other antennas, in that the shape of the septum 714 is modified (relative to the shape of septum 14 of FIG. 1) and bases 724,744 may be either asymmetric or symmetric about the septum (as discussed for antenna 510). In antenna 710, septum 714 is attached in a straight line at the bases and curves gradually towards its top. The bowed shape of septum 714 is useful in expelling energy from antenna 710 and in designing an output beam pattern.

The antennas of FIGS. 10–12 are preferably formed using the 3 part approach (2-subsections and septum) discussed above and the septum is then bent using an appropriately shaped tool and pressure from above.

Referring to FIG. 13, a latitudinal top view of an antenna 810 in accordance with the present invention is shown. Antenna 810 includes bases 824,844, separated by septum 814, amongst other components. In antenna 810, the bases are generally planar and have been drilled or otherwise formed to create counter sink or counter bore like depressions termed "coins" 811 which provide periodically asymmetric surfaces, thus approximating the surfaces of bases 24,44.

Referring to FIG. 14, a perspective end view of an antenna 910 in accordance with the present invention is shown. Antenna 910 includes a septum 914, bases 924,944 and other components as discussed above. Though shown in a symmetric arrangement, bases 924,944 may be formed asymmetrically, in a planar, undulated or other manner. A piece of circuit board 917 or like non-conductive material (such as dielectric material) is placed on top of septum 914, preferably orthogonal thereto. A plurality of conductive elements 918 are provided on circuit board 917. Elements 918 serve to scatter fields in main channel 12 causing energy to be radiated from the channel. Elements 918 are preferably arranged asymmetrically and periodically, for example, approximating the asymmetric sinusoidal bases 24,44 of antenna 10. Elements 918 perform essentially the same function as the sinusoidal surfaces of bases 24,44.

It should be recognized that the features described above may be combined in various combinations to achieve a desired radiation pattern.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

We claim:

1. A trough waveguide antenna, comprising:

a first conductive trough having first and second opposing side walls and first and second bases, said first base connected to said first side wall and disposed toward said second base and said second base connected to said second side wall and disposed towards said first base; and a septum provided between and extending above said first and second bases;

wherein at least one of said first and second bases has longitudinally disposed undulations that are asymmetric about said septum from the other of said first and second bases, and further wherein said undulations are configured in a sinusoidal manner with smooth, curved transitions from peaks to valleys and from valleys to peaks.

2. The antenna of claim 1, wherein said asymmetry is periodic.

3. The antenna of claim 1, wherein said sinusoidal undulations further have smooth, curved transitions over peaks and through valleys.

4. The antenna of claim 1, wherein the height to which said septum extends above at least one of said bases varies substantially linearly along the length of said base.

5. The antenna of claim 1, wherein the amplitude of sinusoidal undulations of at least one of said bases varies along the length of that base.

6. The antenna of claim 1, wherein said septum is provided substantially in a plane that is parallel with said first and second opposing side walls and wherein at least a top portion of the septum, distal from and extending above said bases, is sinusoidally undulated out of said plane having smooth, curved transitions along said out of plane sinusoidal undulations.

7. The antenna of claim 6, wherein the amplitude of the out of plane sinusoidal undulations of the septum varies along the length thereof.

8. The antenna of claim 1, further comprising a second conductive trough having a second septum, said second trough formed integrally with said first trough and disposed at approximately 180 degrees therefrom.

9. The antenna of claim 1, wherein at least one of said first and second side walls possesses an exterior surface and at least a portion of that surface has a plurality of corrugations formed thereon for radiating energy radially outward from said trough in a plane substantially normal to the plane of the septum.

10. The antenna of claim 1, further comprising a filter element formed in at least a portion of the septum.

11. The antenna of claim 1, further comprising an absorber formed within said antenna proximate said filter.

12. The antenna of claim 1, wherein said undulations are aperiodic.

13. A trough waveguide antenna, comprising:

a conductive trough having first and second opposing side walls and first and second bases, said first base connected to said first side wall and disposed toward said second base and said second base connected to said second side wall and disposed towards said first base; and a septum provided between and extending above said first and second bases;

wherein said septum is provided substantially in a plane that is parallel with said first and second opposing side walls and wherein at least a top portion of the septum, distal from and extending above said bases, is sinusoidally undulated out of said plane and has smooth, curved transitions along said out of plane sinusoidal undulations.

14. The antenna of claim 13, wherein the amplitude of said undulations varies along the length of the septum.

15. The antenna of claim 13, wherein the height of the septum relative to at least one of said bases varies linearly or in a smooth, continuous and curved manner along its length.

16. The antenna of claim 13, wherein at least one of said first and second bases is formed asymmetrically about said septum.

17. A trough waveguide antenna, comprising:

a first conductive trough having first and second opposing side walls and first and second bases, said first base connected to said first side wall and disposed toward said second base and said second base connected to said second side wall and disposed towards said first base;

a septum provided in said first trough between and extending above said first and second bases, wherein at least one of said first and second bases has undulations that are asymmetric about said septum from the other of said first and second bases; and a second conductive trough having a third and a fourth base with a second septum provided between and extending above said third and fourth bases, said second trough formed integrally with said first trough and disposed at approximately 180 degrees therefrom.

18. The antenna of claim 17, wherein the undulations of said one of said first and second bases are sinusoidally configured.

19. The antenna of claim 17, wherein said third and fourth bases include undulations that are asymmetric about said second septum.

20.The antenna of claim 17, wherein said first and second troughs are arranged substantially back-to-back.

21. The antenna of claim 20, wherein the septums of said first and second troughs are configured from a common piece of material that extends from said first trough to said second trough.

22. The antenna of claim 17, wherein said first and second troughs are arranged substantially side-by-side.

* * * * *